United States Patent [19]

Meniconi

[11] Patent Number: 4,629,189

[45] Date of Patent: Dec. 16, 1986

[54] PHOTOELECTRIC PINFALL DETECTION SYSTEM

[76] Inventor: Vittorio Meniconi, J.C. Heerstrasse 17A, 8635 Oberdürnten, Switzerland

[21] Appl. No.: 695,448

[22] Filed: Jan. 28, 1985

[30] Foreign Application Priority Data

Feb. 11, 1984 [DE] Fed. Rep. of Germany ..... 3404865

[51] Int. Cl.[4] ..... A63D 5/00

[52] U.S. Cl. ..... 273/54 E

[58] Field of Search ..... 340/562, 565; 273/37, 273/42 R, 46, 52, 54 R, 54 C, 54 E

[56] References Cited

U.S. PATENT DOCUMENTS

| | | | |
|---|---|---|---|
| 3,804,408 | 4/1974 | Saito et al. | 273/54 E |
| 3,825,749 | 7/1974 | Gautraud et al. | 273/54 C |
| 4,140,314 | 2/1979 | Kaenel | 273/54 C |

*Primary Examiner*—Richard C. Pinkham
*Assistant Examiner*—Stuart W. Rose

[57] ABSTRACT

The invention provides a photoelectric bowling pinfall detection system which automatically scans and displays the number of the knocked down pins after each ball delivery. The system comprises an emitter positioned offset to the central longitudinal axis of the bowling lane in a certain distance to the pin arrangement, which emits a sharply focussed beam towards the pins. A receiver is provided behind the pins which detects the receipt of the focussed beam. If the beam is swept along the pins, each standing pin causes an interruption of the beam which is recorded by the receiver and fed to a processing circuitry. From the output signals of the receiver information about the numbers of the knocked down pins is derived and displayed.

34 Claims, 21 Drawing Figures

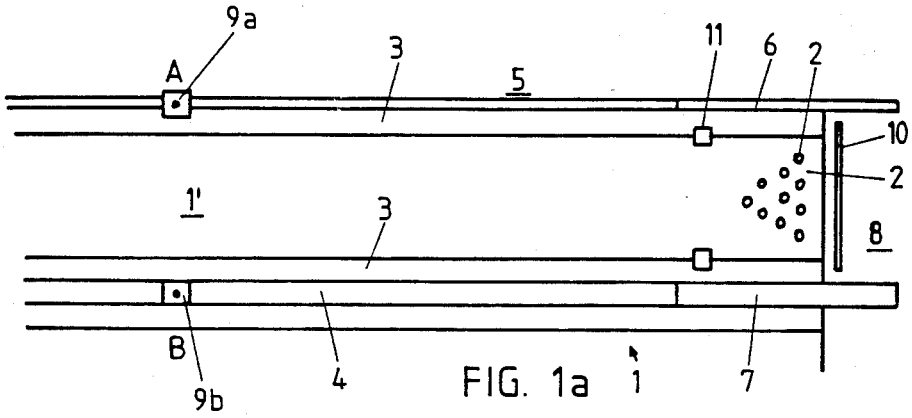
FIG. 1a
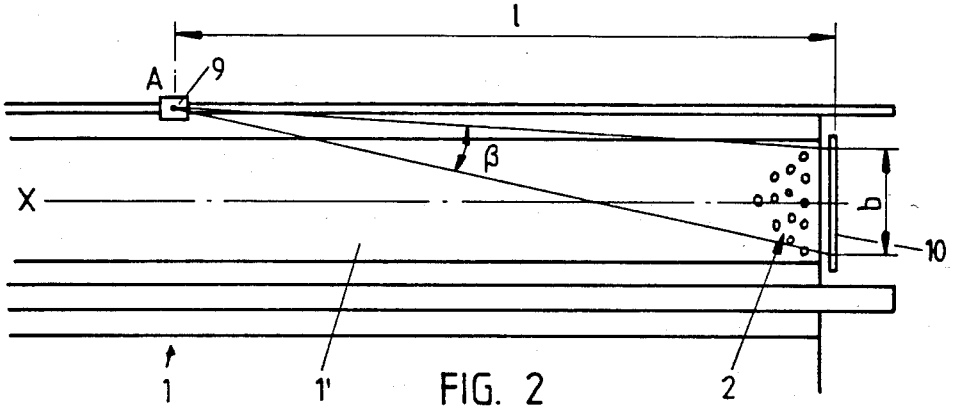
FIG. 2
FIG. 3a
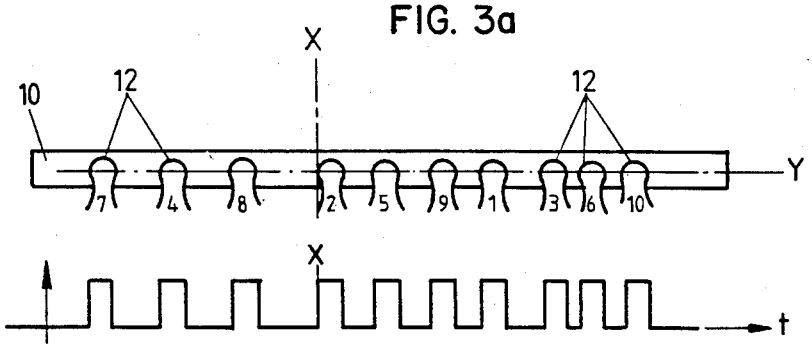
FIG. 3b

FIG. 4
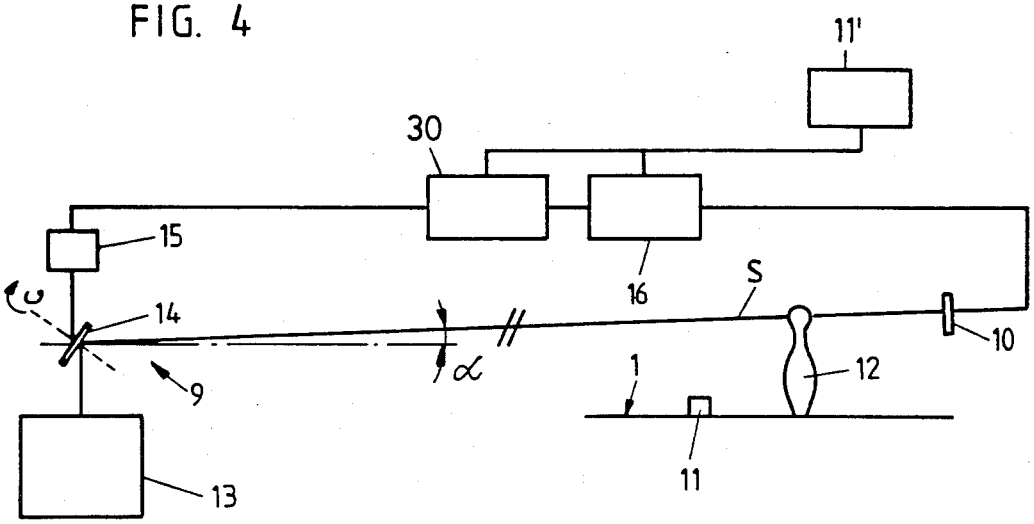
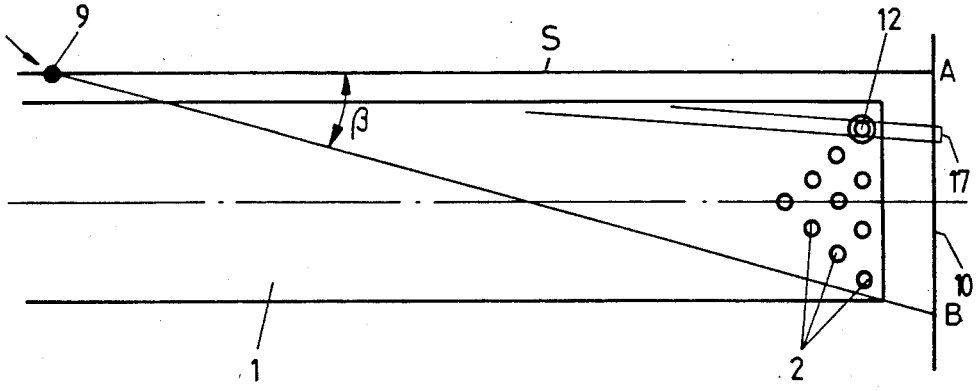
FIG. 5

FIG. 12
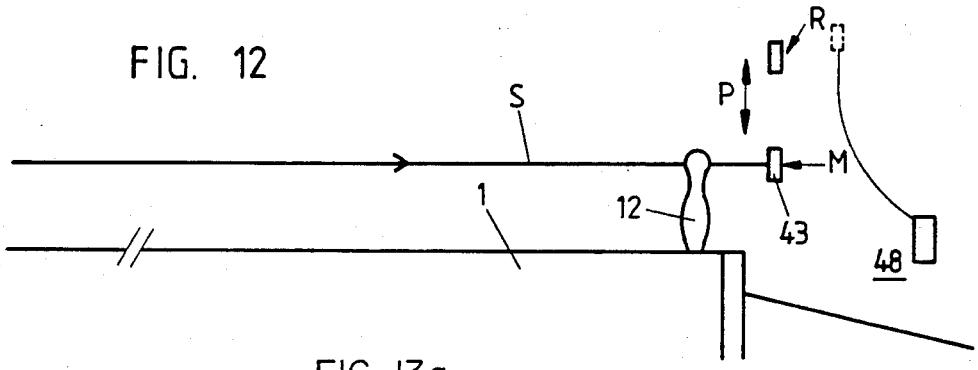
FIG. 13a
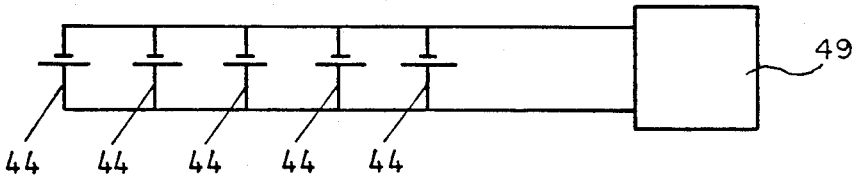
FIG. 13b
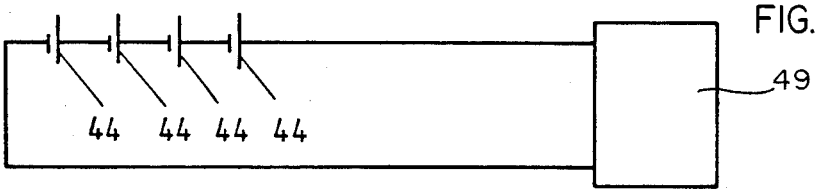
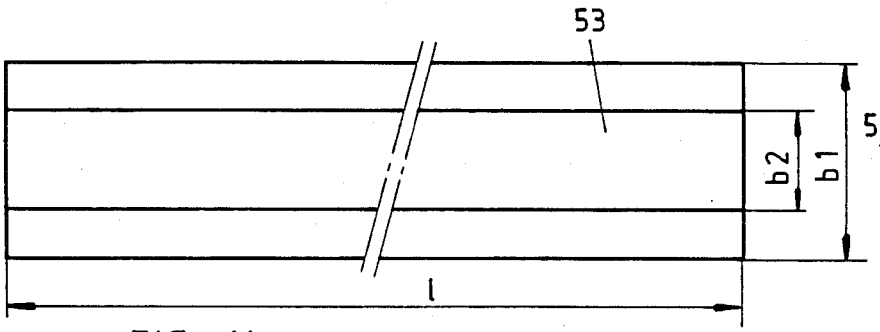
FIG. 14
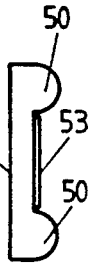
FIG. 15
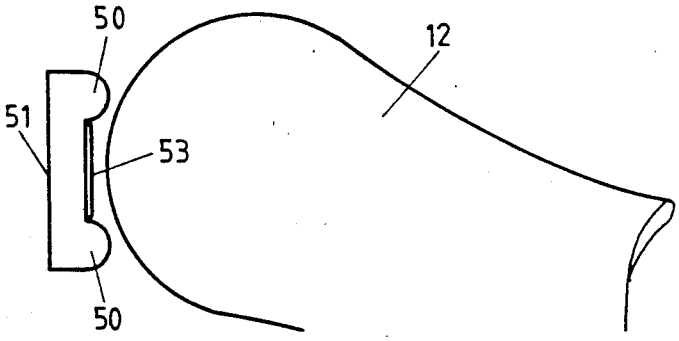
FIG. 16

PHOTOELECTRIC PINFALL DETECTION SYSTEM

BACKGROUND OF THE INVENTION

1. Field of the Invention

The present invention refers to a photoelectric pinfall detection system of the kind in which the pins on a bowling lane are remotly scanned without touching them to detect whether each pin is in an upright position or is fallen. The system according to the invention further includes electronic circuitry to display the result of the scanning, not only after a game has finished, but also during the game.

Modern bowling alleys are equipped with more or less automatically operating pinsetters which do the work that earlier has been done manually by the pin boys. Essentially the pinsetters have to remove fallen pins from the bowling lane and to place a complete set of nine or ten pins in a predetermined arrangement in the region of the end of the bowling lane. Thereby a player is enabled to bowl in the ordinary manner, either to knock down as many pins as possible or selected pins. The ball having been thrown the pinsetter has to remove the fallen pins from the lane; usually this is accomplished by lifting the still standing pins from the lane, removing the fallen pins from the lane and repositioning the lifted pins on the lane again.

It must be born in mind that possibly one or several of the pins might be shifted out of the original position under the influence of the ball or of an adjacent falling pin without falling itself. In accordance with the rule of the game the pinsetter has to put all lifted pins, including those which possibly are shifted out of their original position, back to that former position where they in fact have been standing after the ball had been thrown. Now the player has another throw to knock down the remaining pins by means of a second ball. After this second throw all pins, either still standing or fallen, are removed from the lane and the pinsetter prepares a new game by positioning all ten pins in the correct arrangement at the end of the lane. If all ten pins are knocked down by the first ball, the pinsetter proceeds without delay to prepare a new game.

In the most simple case, the scoring is done visually, i.e. the player counts the number of the standing pins after each ball throw, subtracts that number from ten and makes a note of the result. Of course there is a number of different scoring rules which are well known and which have not to be discussed here.

The disadvantages of such visual scoring of the game results may be summarized as follows:

The pins are standing quite far from the player (appr. 25 meters) and the standing pins in front of the player may obstruct the visibility of pins standing farther behind. Still standing pins in a back row may be overseen easily, especially if such a back row pin stands congruent to a front row pin as seen from the players point of view.

The scoring rules especially of the bowling game are comparatively complicated so that errors in recording and calculating the results may easily occur.

Frequently the results of a game are recorded on a transparent foil or film lying on the illuminated area of an overhead projector. The recorded results are thereby projected in blown up form onto a screen so that all players may see the game results of every player simultaneously. However the considerable difference in light intensity, —very bright illuminated area of the overhead projector, where the results are recorded, versus comparatively low light intensity in the region of the pins being arranged in a 25 meters distance—, greatly stresses the accomodation possibilities of the human eye, leading to a premature fatigue of the players and thereby to errors in recording of the results.

Pinsetters widely used with existing bowling alleys may be equipped with means allowing a partly automated scoring in the following way:

The first ball having been thrown, the pin clamping table of the pinsetter is lowered to a distance of appr. 20 cm above the surface of the bowling lane, whereby still standing pins are grasped by means of especially designed clamping devices related to each pin. Now the standing pins are lifted off the lane as precisely as possible in perpendicular direction to the lane surface and the fallen pins are removed from the lane. Each clamping device is equipped with a sensor, e.g. a mechanical switch, which gives an output signal if a pin has been grasped by the related clamping device; consequently the ocurrence of the output signal may be interpreted such that the related pin has to be considered as "standing pin". The output signals of the clamping devices are fed to a display equipped with a number of indicator lamps, the position thereof corresponding to the position of the pins, and each indicator lamp related to a standing pin will be lit in response to the output signals delivered by said sensing switches. After the second ball having been thrown, all ten pins are repositioned anyway for a new game. The pinsetter thereby removes all pins from the lane, whether fallen or not, to prepare a new game after the second ball. A further lowering of the clamping table to detect the number of still standing pins after the second ball is not performed, but the scoring of the second ball throw must be done visually.

Some of the reasons for proceeding in the above mentioned way are discussed hereinafter, as follows:

As already mentioned hereinbefore, there exists the possibility or danger that some of the pins are displaced in a not foreseeable manner from their initial position without falling, due to the influence of the thrown ball or an adjacent falling pin.

The pinsetter can grasp and clamp only those standing pins which are in their initial position or which are displaced from their initial position but to a limited amount, within a comparatively small region around the initial position. This region of grasping is clearly and definitely defined in the standard specification for the admission of pinsetters. However, if a still standing pin is displaced to a position lying beyond that region, the operation of the pinsetter is interrupted and further operation has to be done manually.

It follows that each scanning operation by means of the sensors in the pinsetter to determine which pins are still standing is disadvantageously time-consuming and therefore expensive. Furthermore, if one or several pins are displaced beyond the above mentioned region, where a pin may be grasped by the pinsetter, a scoring based on the information delivered by the sensors provided in the pinsetter will not be reliable at all, but in most cases incorrect and thereby useless.

2. Prior Art

In an attempt to avoid the above mentioned disadvantages, various pinfall detection devices, even including automatic scoring systems, have been proposed in the prior art. Such devices scan the number of the standing pins after a ball throw and remove the necessity to visually inspect the pins and to manually count the number of pins which have not been knocked down by the ball.

U.S. Pat. No. 3,825,749 for example discloses a photoelectric bowling pin detection device including a light source and a photosensitive element mounted for simultaneous sweep across the pin deck of the lane and a drive motor. The scanner is activated by the passage of a delivered ball past a ball detector. As soon as the sweeping light beam hits the head of a standing pin, a portion of the light beam is reflected back to the photosensitive element. The scanner counts the number of occurrences of detection of the light beam portion reflected by a standing pin and derives therefrom the number of standing pins. A disadvantage of this system is that it does not work satisfactorily in bright ambient light conditions and particularly not, if the heads of the pins are damaged and/or contaminated. Furthermore, if two standing pins are one behind the other one, as seen in the direction of the light beam emitted by the scanner, it is not possible to distinguish between the two pins any longer and these two pins will be interpreted as a single standing pin, which is, of course, incorrect and therefore not desirable at all.

In Swiss Pat. No. 306,671 a pinfall detection system has been disclosed comprising a plurality of light barriers arranged in the region of the position of the pins on the bowling lane. The light beam of each light barrier is interrupted by a related pin as long as the latter is standing at its predetermined position, since the beam emitted by a light transmitter arranged at one edge of the lane cannot be received by a light beam receiver arranged at the opposed edge of the lane. The receivers thereby deliver a positive or a negative output signal, which can be interpreted as the related pin being standing or having knocked down. A first disadvantage of this solution is that a considerable number of transmitters and related receivers has to be provided, i.e. ten in the case of a bowling game, which have to be carefully aligned to each other to ensure proper and reliable operation. A second, probably much more important disadvantage lies in the fact that a pin shifted or removed from its initial position, but still standing, does not cause a beam interruption of the related light barrier anymore; consequently such a still standing pin will be interpreted by this system (incorrectly) as a fallen pin.

A pinfall detection system according to the disclosure of German Patent Publication No. 16 03 014 operates also on the basis of a light beam which is reflected by a standing pin and partially received by a photosensitive receiving element; it shows the same disadvantage as hereinbefore discussed in connection with U.S. Pat. No. 3,825,749. A similar solution is disclosed by U.S. Pat. No. 3,705,722; an elongated flash tube is lowered in a position behind the pins after a ball has been delivered and a flash impulse is sent to the heads of the pins. Each standing pin will cause a reflection of the flash and such reflected light beams will be received by a group of receivers focussed to a group of adjacently positioned pins. The number of received reflection signals will be proportional to the number of pins still standing. This latter solution shows the same disadvantages as well, even if it must be admitted that the influence of damage or contamination of the pin heads should be somewhat less due to the shorter distance between light source, pins and receivers. However if the pins are displaced without falling, a distinction between two congruently positioned pins will not be possible.

OBJECTS OF THE INVENTION

It is a principal object of the present invention to provide a pinfall detection system which does not exhibit the disadvantages mentioned hereinbefore, but which will ensure, by means of a contactless scanning of the standing pins, to reliably, quickly and economically detect the number of the standing pins and to display the result, not only after the first ball delivery, but also after the second one and lastly after completion of the game.

It is a further object of the invention to clearly and reliably identify such pins which have been shifted or displaced by a ball or by an adjacent falling pin as still valid, standing pins.

A still further object of the invention is to provide a system which reliably operates even in bright ambient illumination and independently of the condition of the pins, even if they are damaged and/or contaminated.

A still further object of the invention is to provide a pinfall detection system which is of comparatively simple construction, thereby being inexpensive to manufacture and does not require skilled servicing.

A final object of the invention is to provide a bowling alley with a plurality of bowling lanes arranged parallel to each other and including photoelectric pinfall detection systems which quickly and reliably detect and display the results attained on each individual bowling lane.

SUMMARY OF THE INVENTION

Basically the invention provides a photoelectric pinfall detection system which includes a radiation emitter standing offset to the longitudinal axis of a bowling lane in a predetermined distance to the pins arranged at the end of the bowling lane. This emitter sends out an electromagnetic signal beam which is focussed at least in one plane, for example in a horizontal plane, or according to a preferred embodiment focussed along a straigt line. Further, there is provided a receiving means including a receiving element adapted to receive the electromagnetic beam emitted by the radiation emitter and to generate a first output signal in response to the receipt of said electromagnetic beam, as well as a second output signal, if no electromagnetic beam is received.

An electronic circuitry is connected to the radiation emitter and the receiving element in order to receive said first and said second output signals from the receiving element. The received first and second output signals are processed in a processor circuitry included in said electronic circuitry and fed to a display means to display the number and position of the fallen pins in response to the first and second output signals. In order to generate said first and second output signals, the electromagnetic beam emitted by the emitter and the receiving element included in said receiving means are movably arranged with reference to each other in such a way that the electromagnetic beam is interrupted by each standing pin, whereby such interruption is detected during the relative movement of the beam and the receiving element.

Generally speaking, the electromagnetic beam emitted by said emitter advantageously is a light beam, whereby the emitter may comprise a light source which emits a short-wave light beam, particularly a light beam having a wavelength in the infrared spectrum. Optical focussing means may be positioned in front of the light source to focus said light beam at least in one plane, in some preferred embodiments even along a straight line. Said light source may be a semiconductor diode.

Several modifications and further embodiments of the basic pinfall detection system as hereinbefore identified will be further described in the following.

According to a further aspect of the invention, there is provided a bowling alley with a plurality n of bowling lanes arranged parallel to each other and including a plurality of photoelectric pinfall detection systems related to each bowling lane. Consequently, such a bowling alley includes a plurality n+1 of radiation emitters each standing offset to the longitudinal axis of an adjacent bowling lane in a predetermined distance to the pins of the adjacent bowling lane between each of two adjacent bowling lanes as well as at the two free edges of the two outermost bowling lanes. Each of the radiation emitters emits an electromagnetic signal beam which is focussed at least in one plane, but preferably along a straight line.

A plurality n of receivers is further provided, each including a receiving element adapted to receive the electromagnetic beam emitted by one of said radiation emitters and to generate a first output signal in response to the receipt of the electromagnetic beam and a second output signal, if no electromagnetic beam is received. Each of a plurality of electronic circuitries, each related to an individual bowling lane, is connected to two adjacent radiation emitters and to the related receiver and receives said first and said second output signals from the receiver. The received first and second output signals are processed and delivered to display means to display the number and position of the fallen pins of the related bowling lane in response to said first and second output signals.

As previously described in connection with the basic system, the electromagnetic beam emitted by the emitters as well as the receiving element included in said receiving means are movably arranged with reference to each other in such a way that the electromagnetic beam is interrupted by each standing pin and that such interruption is detected during said relative movement of the beam and the receiving element.

Preferably the electromagnetic beam emitted from one of said emitters is received by the receiving means related to two adjacent bowling lanes and processed by the electronic circuitry means related to said two adjacent bowling lanes.

BRIEF DESCRIPTION OF THE DRAWINGS

In the following there will be described a number of embodiments of the pinfall detection system according to the invention, with reference to the accompanying drawings, in which:

FIG. 1*a* shows a schematic plan view of a bowling lane,

FIG. 2 shows the plan view of FIG. 1*a* with some more details of the invention, FIG. 3*a* shows a schematic view of an embodiment of the receiver including a projection of the pin heads arranged in front of the receiver, FIG. 3*b* shows a pulse diagram resulting at the outputs of the receiver with an arrangement according to FIG. 3*a*, FIG. 4 shows a schematic diagram of the general arrangement of the pinfall detection system according to the invention, FIG. 5 shows a schematic top view of an arrangement according to the invention, FIG. 12 shows a schematic side view of the embodiment of FIG. 6, FIG. 13*a* shows a part of a block diagram of a first embodiment of a receiver means, FIG. 13*b* shows a part of a block diagram of a second embodiment of a receiver means, FIG. 14 shows a partial front view of a reflector element to be used with the system according to the present invention, FIG. 15 shows a vertical sectional view of the reflector element of FIG. 14, FIG. 16 shows a view similar to FIG. 15, together with a part of a pin.

DESCRIPTION OF SOME PREFERRED EMBODIMENTS

Figure 1:
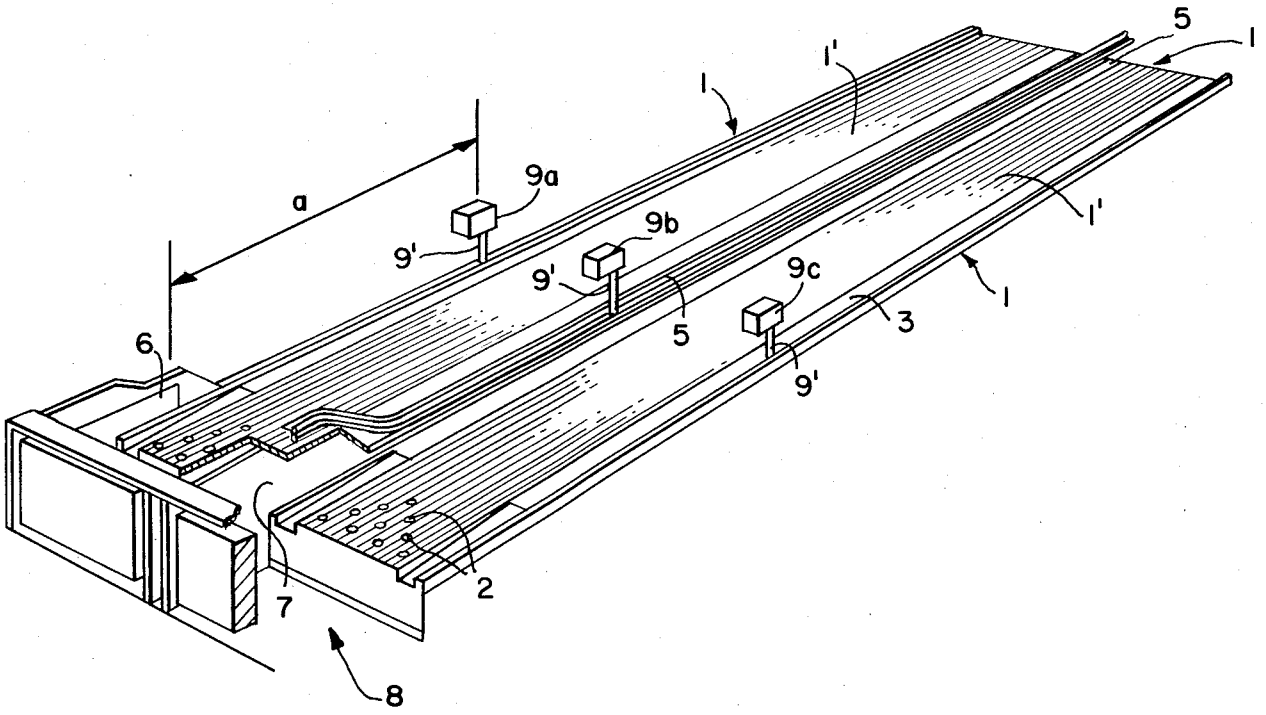
FIG. 1 shows a perspective view, partially sectioned, of a pair of adjacent bowling lanes incorporating the system according to the present invention.

In FIG. 1 there is shown a perspective view of two adjacent bowling lanes, parts of one lane and the end region being sectioned for more clarity, while FIG. 1*a* shows a schematic top view of the end part of one of the bowling lanes of FIG. 1. The bowling lane 1 includes a pin deck 1', at the end of which a total of ten pins are to be positioned in a well-defined arrangement. For that reason the pindeck 1' comprises ten pin spots 2 on its surface. Each lane 1 is terminated along its two longitudinal edges by a gutter 3. Along the edge of the lane 1 there is further provided a ball return 4, preferably one single ball return 4 used by two adjacent bowling lanes 1. Adjacent lanes 1 are delimited against each other by division boards 5. In the region of the position of the pins, there are provided kickback plates 6 and 7, respectively, and behind the end of the pin deck 1', there is provided a ball receiving area 8 adapted to receive and guide the ball after it has been delivered.

The size and dimensions of the lane 1, the arrangement of the pin marks 2 at the end of the pin deck 1', the design and the dimensions of the pins etc. are the subjects of internationally approved regulations and need not be further discussed within the scope of the present invention.

As can be further seen from FIGS. 1 and 1*a*, the system according to the present invention comprises at least one emitter, which is positioned on a stand 9' in the region of an edge of the lane 1 in a distance a to the center of the pin marks 2. According to the embodiment of FIG. 1, a total of three emitters 9a, 9b and 9c is provided, each mounted on a stand 9', serving to detect the pinfall on two adjacent lanes 1. As will be further explained hereinafter in more detail, each of the emitters 9a to 9c can perform a double function, i.e. each emitter may be used for two directly adjacent lanes 1.

Basically each emitter 9 emits an electromagnetic detection beam, directed toward the pins, said beam being focussed in one of different ways, as will be explained later in full detail. Of course you are free to choose a suitable kind of electromagnetic beam; however it has proven advantageous to use a light beam, particularly a red light beam having a short wave length in the region of dark red or infrared. Preferably such red or infrared light beam is generated by a suitable laser diode element providing a geometrically well defined beam which can easily be focussed in any desired manner.

Furthermore there is provided a receiver 10 (FIG. 1a) for each lane 1 and related thereto, which is adapted to receive and recognize the receipt of a beam emitted by one of the emitters 9. The arrangement of emitters 9 and receiver 10 is such that a beam from the emitter 9 directed to the receiver 10 is interrupted by standing pins. As a plurality of pins has to be scanned with one beam generated by one emitter, a relative movement between the beam generated by the emitter 9 and the receiver 10 must be provided. There are a number of preferred possibilities to realize such relative movement, as will be explained later on in full detail.

The colour of the emitted beam, i.e. its wavelength, is not of great functional importance because the system according to the invention will properly operate with nearly all kinds of electromagnetic beams. However it has proven advantageous to chose a light beam with a colour which is clearly contrasting to the ambient light in bowling alleys, but which can be recognized nevertheless by the human eye in order to facilitate the installation and the adjustment of the system. The important point is that the beam be sharply focussed in one dimension at least, i.e. for example in a horizontal plane, so that the effective operational width thereof in that dimension be considerably smaller than the diameter of the head of a pin (diameter appr. 64 mm).

The position of the emitters 9 is chosen such that a focussed beam emitted by the emitter 9 and being swept along the width of the lane 1 normally, i.e. with all pins standing exactly on the related pin marks 2, hits all pin heads with clear distinction. Since the pins are arranged symmetrically to the central axis X of the pin deck 1' (FIG. 2), it will be necessary to position the emitter or the emitters 9 offset to said axis X. If the aforementioned distance a between the emitter 9 and the center of the pin marks 2 is appropriatly chosen, the above condition can easily be fulfilled, as will be explained hereinafter in connection with FIGS. 3a and 3b.

It may be further seen from FIG. 1a that the receiver 10 is arranged beyond the end of the pin deck 1', behind the pin marks 2 and thereby behind the pins to be placed on the pinmarks. The receiver 10 may be, according to the embodiment shown in FIGS. 1a and 2, of elongate configuration and comprises a plurality of photosensitive elements to be hit by the sweeping beam. Other configurations are possible and will be described in more detail furtheron. The elongate strip-like receiver 10 of FIGS. 1a and 2 is arranged directly behind the back row of the pins, perpendicularly to the central axis X of the pin deck 1' and in a height which corresponds essentially to the height of the head of a standing pin. The length of the strip-like receiver 10 is such that it reliably covers the projected width of the pin arrangement and may be hit by a beam emitted from the emitter 9 swept along the pin arrangement.

According to a particular embodiment, it may be advantageous to mount the strip-like receiver 10 behind the pins displacably in a vertical direction. Normally the receiver 10 will be in a lifted rest position considerably above the pin heads where it is protected from damage which could be caused by a delivered ball or a falling pin. The ball having been delivered, the receiver 10 is lowered to its operating position, i.e. to a height directly behind the pin heads; thereby it is possible to detect the number of still standing pins, as will be further described later on.

In the following, the basic principles of operation of the pinfall detection system according to the invention will be explained in more detail. As soon as a ball has been delivered, a trigger device 11, e.g. a light barrier or a similar device, which is arranged in the region of the end of the pin deck 1', will be activated, thereby initializing a scanning cycle of the detection system as well as the operational start of the pinsetter. Furthermore the occurence of the trigger signal causes the receiver 10 to be lowered from its rest position to its operating position, as hereinbefore explained. After a short delay according to the rules of the game, the still standing pins are scanned by means of the pinfall detection system of the invention and the number thereof recorded and displayed. Thereby at least one electromagnetic beam emitted by an emitter 9 is deflected by suitable means and swept over the pin arrangement in such a way that the receiver 10 is hit by the beam along its full photosensitive length. Each standing pin will cause an interruption of the beam emitted from the emitter 9. Such interruptions of the beam effect a change of the physical state of the photosensitive elements provided in the receiver 10, depending of the kind and design thereof, and a signal train having two different states will result at the output of the receiver. This signal train is fed to an electronic circuitry, to be described later, for further processing and display of the result.

The basic arrangement of the photoelectric pinfall system according to the invention within a bowling lane 1 is shown in FIG. 2 in a schematic top view. The position of the emitter 9 as well as the position of the receiver 10 is known and the distance 1, i.e. the distance between emitter 9 and receiver 10 measured in the direction of the central axis X can be calculated. The effective length of the receiver 10 is defined as distance b. The pins are exactly positioned on the related pinmarks 2 at the end of the pin deck 1'. The beam emitted by the emitter 9 may be swept over the pin arrangement at least over an angle $\beta$ to cover the entire effective length of the receiver 10.

The following parameters are known:

distance between emitter and receiver: 1 (m)

sweep speed of the beam: Vs (m/sec)

diameter of the pin head: Dp (mm)

As $1 >>$ than Dp, the width of the picture of the pin head projected to the surface of the receiver 10 may be calculated as Dp too without significant error.

Based on the above listed parameters, the length of time (Pu) of a beam interruption caused by a standing pin may be calculated as follows:

$$Pu = Dp/Vs \text{ (sec)}.$$

It will be evident that every standing pin will cause a beam interruption having approximatly the same value of Pu.

In FIG. 3*a* there is shown the picture of the ten heads of the pins 12 projected by the beam from the emitter 9 (FIG. 2) to the surface of the receiver 10, the pins 12 being in the initial, basic position according to the rules. The reference number of the pins 12 as shown in FIG. 3*a* corresponds to the numbering of the pins according to the ABC regulation. The central axis of the pin deck 1' is defined by X and the path of the beam emitted from the emitter 9 is identified by Y. FIG. 3*b*, immediatly below FIG. 3*a*, shows a diagram in the same scale containing the shape of a pulse train occurring at the output of the receiver 10. It is understood that according to FIGS. 3*a* and 3*b* all ten pins are standing, thereby causing ten beam interruptions during one single sweep; thus the diagram of FIG. 3*b* correspondingly shows ten pulses reflecting the tenfold beam interruption. Remember, all ten pins are in upright position and the bowling alley is in its initial state, ready for the beginning of a game.

If one or several of the pins have been knocked down by a delivered ball, these pins will not cause a beam interruption any longer and consequently the corresponding pulses will not occur in the pulse train of FIG. 3*b*. In such a case a simple electronic circuitry will be in a position to recognize the absence of some pulses and to display either the number and/or position of the still upright or the number and/or position of the knocked down pins. Such electronic circuitry is well known in the art and need not to be discussed further.

However, it may happen that one or several pins are displaced from their initial position, either by the delivered ball or by adjacent falling pins, but without falling themselves. The resulting projected picture on the surface of the receiver 10 will then be different since the projected pictures of two or more pin heads may overlap. In this case the duration of the beam interruption will be longer, and consequently the corresponding pulse at the output of the receiver 10 will be longer in duration as well. But if the total number of pulses and the number of pulses with increased duration, as compared to the normal condition, is logically processed, the exact number of the still standing pins may be derived, even if some of the projected pictures of the pins partially overlap.

The following definitions shall be true:

measured duration of beam interruption: Pug (msec)

duration of beam interruption caused by a single pin head: Pu (msec)

safety delay: Sf (msec)

The following table shows the relation between the measured duration of a beam interruption and the number of pin heads, the projected pictures of which overlap on the surface of the receiver 10.

TABLE I

| number of standing pins with overlapping projection | measured duration of pulse Pug (msec) |
|---|---|
| 1 pin (no overlap) | Pu + Sf |
| 2 pins overlapping | Pug > Pu + Sf < 2 Pu |
| 3 pins overlapping | Pug > 2(Pu + Sf) < 3 Pu |
| 4 pins overlapping | Pug > 3(Pu + Sf) < 4 Pu |

The theoretical maximum of pin heads, the projected pictures thereof may overlap on the surface of the receiver 10 as seen from the position of the emitter 9, is four. However, considering the dynamic forces exerted by a delivered ball to the pins 12 and further considering the position of the pins 12 on the pin deck 1', practise has shown that maximally three standing pins may be displaced such that their projected pictures overlap on the surface of the receiver 10, of course as seen from the position of the emitter 9 again. In the worst case it may happen that, under the influence of three standing, but displaced pins 12, a pulse duration of $$Pug < 2(Pu + Sf)$$

results. It is readily understood that such condition must lead to an error in counting in the amount of one pin.

In order to reliably avoid this error, the system according to the invention provides the possibility to use a second emitter 9, positioned at the opposed edge of the pin deck 1' and cooperating with the same receiver 10. The scanning of the still standing pins is thereby performed from the other side and under a different "viewing" angle. If such error occurs, the output signals of the receiver 10 resulting from the first scanning cycle by means of the first emitter 9 on the one side of the lane will be different from the output signals of the same receiver 10, but resulting from the second scanning cycle by means of the second emitter 9 on the other side of the lane. A correction signal may be derived from these two sets of output signals, since the higher number of standing pins will be true.

FIG. 4 shows a schematic side view of the basic design of an embodiment of the pinfall detection system according to the invention. As already mentioned, the system includes an emitter 9 incorporating a light source 13, which may be a infrared emitting laser diode. The diameter Sd of the beam emitted by the laser diode 13 is much smaller than the diameter Kd of the head region of a pin 12, i.e.: Sd<<Kd. In the embodiment shown in FIG. 4, there is provided a mirror 14 mounted in front of the light source 13 deflecting the beam S in such a way that it hits the receiver 10 arranged beyond the end of the pin deck 1', if no pin 12 is in its path. The path of the beam S is somewhat upwardly inclined with reference to the horizontally extending surface of the pin deck 1', as shown by the angle $\alpha$ in FIG. 4. The mirror 14 is connected to a driving unit 15 adapted to rotate or sweep the mirror 14.

As soon as a ball has been delivered and has passed the trigger device 11, the following operational procedure is initialized: The driving unit 15 is energized and the mirror 14 is rotated or swept in such a way that the beam S emitted by the light source 13 and deflected by the mirror 14 hits the receiver 10 along its full effective length, either from the left to the right or vice versa. Standing pins 12 have their head in the rotating or sweeping plane of the beam S and thereby cause an interruption of the beam S. Every time the beam S is interrupted, the output signal of the receiver will change its state so that a pulse train similar to the one shown in FIG. 3*b* will occur. The pulse train is fed to a processing circuitry 16, which processes the output signals according to preselectable rules and diplays the result, and which also is connected to a control circuit 30 for the drive unit 15 as well as to a triggering circuit 11' which is controlled by the trigger device 11.

Figure 6:
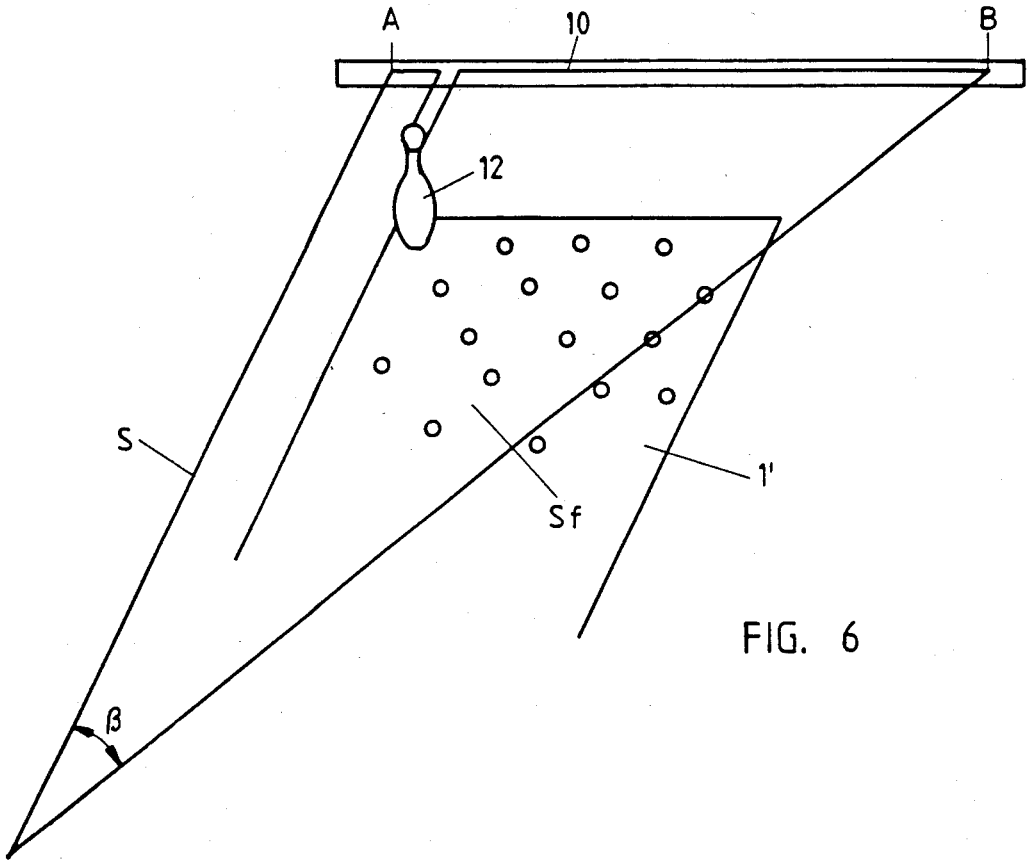
FIG. 6 shows a schematic elevational partial view of a first embodiment of the system according to the invention.

In FIGS. 5 and 6 the design of the system of the invention, schematically shown in FIG. 4, is shown in a schematic top view (FIG. 5) and in a partial perspective view. It may be clearly recognized that the sole standing pin 12 has the effect that the beam S swept around an angle B passes a region 17 where no light is hit to the photosensitive surface of the receiver 10. The processing circuitry derives from this single beam interruption in the region 17 the conclusion that all other pins 12 have been knocked down.

It is understood that the beam emitted from the emitter 9 may be rotated around an angle of 360°, if desired, i.e. the emitter 9 or the deflection mirror 14 in front of the light source 13 may be rotated by means of the driving unit 15. In this case the interconnection of the control circuitry 30 related to the driving unit 15 with the processing circuitry 16 is such that the output signals of the receiver 10 are processed only during a certain intervall of rotation, namely at that interval when the beam S passes the region from point A to point B, i.e. when it is rotated about the angle $\beta$ (cf. FIG. 5).

Figure 7:
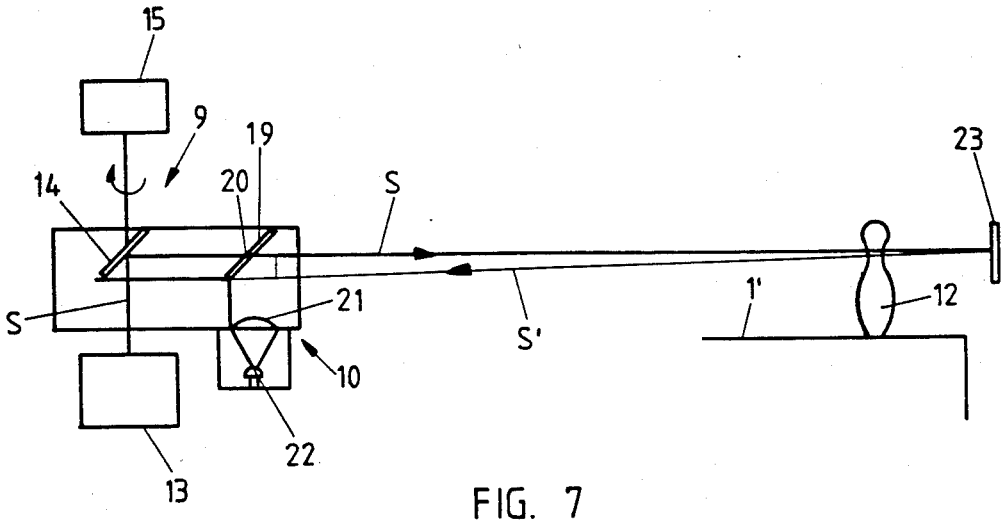
FIG. 7 shows a schematic side view of a second embodiment of a system according to the invention.

Another embodiment of the pinfall detection system according to the present invention is schematically shown in FIG. 7. The emitter building block, generally designated with reference numeral 9 again, includes also the receiver 10 besides the intrinsic emitter elements. The beam S generated by a light source 13 hits a mirror 14 which is inclined by an angle of 45° with reference to the beam axis; the beam is thereby deflected by an angle of 90°. The mirror 14 is connected to a driving unit 15 which is adapted to rotate the mirror 14 or to reciprocally pivot it around a certain angle. As already mentioned hereinbefore, the driving unit is connected to and controlled by a control unit (not shown in FIG. 7), which itself is connected to the previously mentioned processing circuitry. A further mirror 19 is situated at a certain distance in front of the mirror 14, said further mirror 19 having a central opening 20. The beam S deflected by the mirror 14 passes through the opening 20 and is directed to a deflector 23 which is positioned in the region of the end of the pin deck 1' behind the pins 12.

If there isn't any pin 12 in an upright position in the path of the beam S, the latter will be reflected by the reflector 23 and returns as reflected beam S' to the mirror 19. The design and construction of the reflector 23 will be explained later. The reflected beam S' is deflected by 90° by means of the mirror 19, passes a focussing lens 21 and is received by a photosensitive receiving element 22 of the receiver 10, e.g. a phototransistor.

Depending on the fact whether the photosensitive element 22 is hit by the reflected beam S' or not, the latter condition being caused by a standing pin 12 interrupting the beam S, different output signals occur at the output of the photosensitive element 22. These output signals are processed in the processing circuitry 16 and fed to a display, indicating the number of the knocked down and/or the number of the still standing pins 12.

As reflector elements to be used in the reflector 23, conventional commercially available reflex foils or triple reflectors may be used. Both kinds of reflector elements are characterized by the fact that they reflect a light beam essentially per se, i.e. the direction of the outgoing, reflected beam is, with a slight offset, essentially parallel to the incoming beam. In contrary to mirrors, where the angle of incidence of a light beam is equal to the angle of emergence of the reflected beam, the angle between the plane of the reflector element of such reflectors and the incident beam is more or less unimportant within certain limits. In the case of commercially available reflex foils or triple reflectors the allowable angle of incidence of the incoming beam to be reflected may be as much as 45° without a considerable loss of energy in the reflected beam portion.

Figure 8:
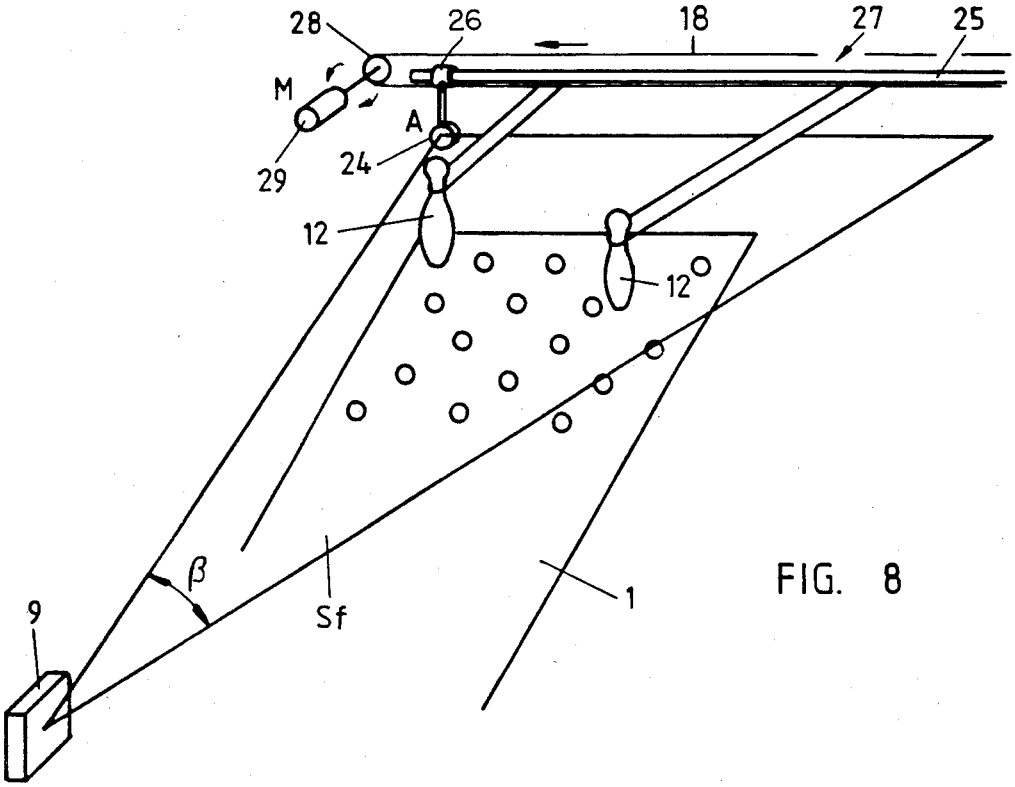
FIG. 8 shows a schematic elevational partial view of a third embodiment of the system according to the invention.

FIG. 8 shows a schematic, perspective partial view of a further embodiment of the pinfall detection system according to the invention. Here the beam SE emitted by the schematically shown emitter 9 is focussed in an essentially horizontally extending plane and covers a central opening angle $\beta$. Of course the angle $\beta$ is chosen so that the entirety of the pin arrangement at the end of the pin deck 1' is covered. However the focussing of the beam SE in a plane perpendicular to said horizontal plane is very sharp. To this purpose the light source (not shown in FIG. 8) can be equipped with an optical focussing system which is known in the art and which generates a spread, thin beam plane in the kind of a circle sector. The position of the emitter 9 with reference to the lane 1 is essentially the same as hereinbefore described in connection with the previously discussed embodiments.

The receiver comprises a photosensitive receiving element 24 which is mounted on a supporting structure 27 situated in the region of the end of the pin deck 1' behind the pins 12. The receiving element 24 is laterally displaceable along the width of the pin deck 1'. The embodiment shown in FIG. 8 comprises a horizontally extending supporting bar 25 on which a supporting member 26 receiving the photosensitive element 24 is slidably mounted. The supporting member 26 is connected to a rope drive 18, including a pulley 28 driven by an electric motor 29. Advantageously the motor 29 is controlled by the processing circuitry. The pulley 28 may be rotated in either direction, whereby the photosensitive element 24 may be displaced along the supporting bar 25 over the entire width of the lane 1. Each standing pin 12 causes an interruption of the sector-like beam Sf. During its travelling path along the width of the lane 1, the photosensitive element 24 may be hit by the beam Sf, thereby generating a first output signal, or may be in a darkened area behind a standing pin, thereby generating a second output signal. During the displacement of the photosensitive element 24 along the width of the bowling lane 1, a pulse train will occur at the output of the receiving element 24, which can be further processed and used to display the number and position of the knocked down pins.

It is advantageous to displace the photosensitive element 24 continuously with a constant speed v along the supporting bar 25 so that the projected pictures of the pin heads are transformed in electric signal pulses of constant width, facilitating their further processing.

Figure 9:
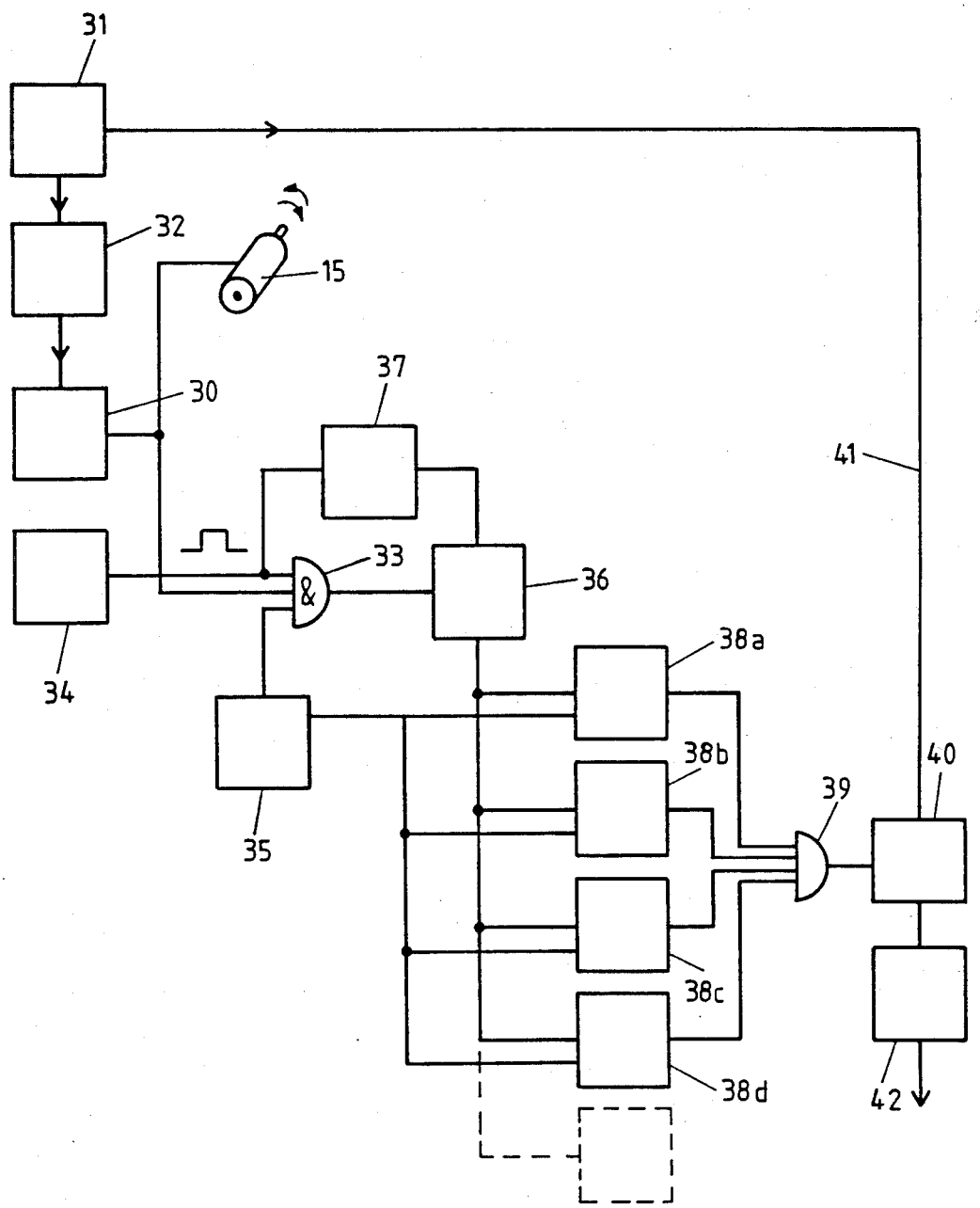
FIG. 9 shows a block diagram of the electronic control and processing circuitry.

In order to further process the output signals obtained from the receiver 10 and to detect and display the number of still standing pins 12 on the pin deck 1', a processor circuitry may be used, the schematic block diagram thereof being shown in FIG. 9. The circuitry comprises a driving unit control circuit 30 which receives information pulses from the sensors of the trigger device 11 as well as from the control circuit 31 for the pinsetter via an initializing circuit 32. The output of the drive control circuit is connected, on the one hand, to the driving unit 15 and, on the other hand, to an AND-gate 33. A further input of the AND-gate 33 is connected to the light receiver 34, while a reference oscillator 35 is connected to the remaining free input of the AND-gate 33. The output of the AND-gate 33 is connected to the input of a counter 36; in order to reset the counter, there is provided a differentiator 37 controlled by the output of the light receiver 34.

Furthermore a plurality of parallely connected decoders 38*a* to 38*d* is provided, the inputs thereof being connected, on the one hand, to the output of the counter 36 and, on the other hand, to the reference oscillator 35. The outputs of the decoders 38*a* to 38*d* are connected to the inputs of an OR-gate 39, whose output is connected to the input of a further counter 40. The reset pulse for the counter 40 comes from the control circuit 31 for the pinsetter via a connection 41. The output of the counter 40 is connected to a decimal decoder 42 which drives in known manner a display (not shown).

The control circuit 31 for the pinsetter or an independent circuit (not shown), e.g. a light barrier used as ball detector, delivers the information required to activate the initializing circuit 32. The latter one starts the drive control circuit 30 and the driving unit 15 starts rotating. Now the beam runs along the path between points A and B (cf. FIG. 6) in either direction. At the points A and B, there are provided position or end sensing switches. Simultaneously, i.e. during the sweeping movement of the beam S between the points A and B or vice versa, the drive control circuit 30 gives a logical 1 signal to the AND-gate 33.

The light receiver 34, the output thereof being connected to an input of the AND-gate 33 as well, generates a logical 0 signal if the beam is received, or a logical 1 signal, if the beam is interrupted by a standing pin and is therefore not received. The oscillator 35, whose output is connected to an input of the AND-gate 33 as well, generates a signal with a frequency fo. The value of that frequency is not critical, but it must fulfill only one condition:

$$fo >> 1/Pu$$

whereby Pu=duration of the beam interruption (sec) caused by a standing pin.

The truth table of the AND-gate 33 is as follows:

| drive control circuit 30 | light receiver 34 | oscillator 35 | output gate 33 |
|---|---|---|---|
| 0 | 0 | 1 | 0 |
| 1 | 0 | 1 | 0 |
| 1 | 1 | 1 | 1 osc-signal |

If the output of the drive control circuit 30 is "1" and the beam S is interrupted during its sweeping movement, the output of the light receiver 34 will generate a "1" signal as well having a length: Ps>Pu, whereby Ps=effectively measured beam interruption (sec)

Pu=duration of beam interruption, caused by a standing pin (sec).

During the time intervall Ps the pulses of the oscillator 35 appear at the output of the AND-gate 33; the number Ai thereof can be calculated with the following equation:

$$Ai = Ps \cdot fo$$

The number Ai of these pulses is counted by the counter 36. The decoders 38*a* to 38*d* connected to the counter 36 have to generate an output pulse as soon as a certain, predetermined counter state is reached. The number to be decoded by the four decoders must be calculated according to the frequency fo of the oscillator 35 and according to the pulse width caused by the interruption of the beam under the influence of a standing pin.

There shall be:

fo (1/sec)=frequency of the oscillator

Pu (sec)=pulse width of the beam interruption caused by a single pin.

Then the following must be true:

$$1 < Z1 < Pu \cdot fo$$

$$Pu \cdot fo + 1 < Z2 < 2 \cdot Pu \cdot fo$$

$$2 \cdot Pu \cdot fo + 1 < Z3 < 3 \cdot Pu \cdot fo$$

$$3 \cdot Pu \cdot fo + 1 < Z4 < 4 \cdot Pu \cdot fo$$

whereby Z1 to Z4 means the preset counting state of the decoders 38*a* to 38*d*.

It can be clearly seen from the above explanations that the accuracy and the resolution of this mesuring method may be increased at will by an increase of the frequency fo.

As soon as the related preset counting states Z1 to Z4 are reached, the decoders 38*a* to 38*d* generate a pulse which is fed to the counter 40. The state of the counter 40 will then correspond to the number of the still standing pins. After a subtraction from ten the result can be recorded in the corresponding forms as it is done also in the case of a visual inspection of the pins, or the result may be further processed by a more sophisticated processing unit. However the latter one is not a subject of the present invention and it will not be further discussed.

As already mentioned there exists a number of different possibilities for the design and construction of the light receiver. In the following, two embodiments thereof will be further described, which seem to be most advantageous for the use with bowling alleys under the rough conditions which there exist.

Figure 10:
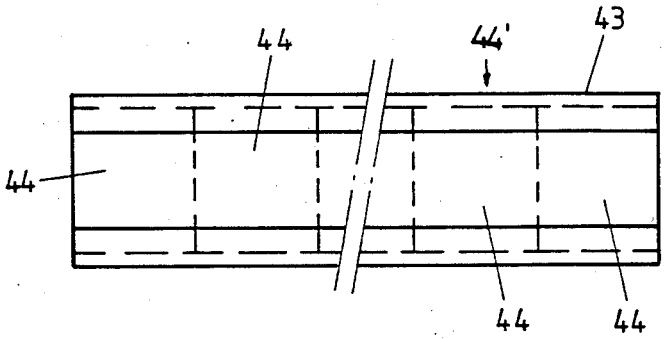
FIG. 10 shows a schematic front view of a receiving means.
Figure 11:
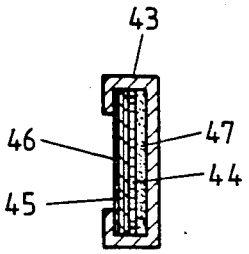
FIG. 11 shows a vertical sectional view of the receiving means according to FIG. 10.

A first embodiment of the photosensitive element 44' of the receiver is shown in FIGS. 10 and 11, whereby FIG. 10 shows a front view and FIG. 11 a sectional view. A supporting member 43, made e.g. of an aluminum profile, is of elongate configuration and receives a plurality of solar cells 44 arranged in a row along the supporting member 43 one adjacent to the next one. The solar cells are of square or rectangular shape and are arranged in the row in such a way that a light sensitive strip is realized, having a length of appr. 1300 mm and a width of appr. 30 mm. The gaps between the invididual cells 44 usually are less than 0.1 mm in width and do not influence the operation of the system, as the beam point diameter of the incoming beam has a dimension of some few millimeters.

As can be seen from FIG. 11, a protective window 45 as well as a colour filter foil 46 is placed in front of the solar cells. The foil 46 lets pass only the wave length of the beam thereby greatly reducing any interference caused by ambient light influence. Another or an additional possibility to to decrease the influence of ambient light is to modulate the signal beam in any suitable manner. The complete sandwich of solarcells 44, colour filter foil 46 and protective window 45 may be fixed to the aluminium profile supporting member 43 by means of a layer 47 of silicon adhesive.

The position of the above described light receiving element 44' with reference to a bowling lane 1 may be seen from FIG. 12. The supporting member 43 is mounted in a suitable place within the ball receiving area 48, i.e. behind the end of the lane 1. In order to avoid any damage caused by falling pins 12 or by the thrown ball, the supporting member 43 is vertically displaceable in the direction of the arrow P and may be lowered from a rest position R to an operating position M and vice versa. During the game the supporting member 43 is in its rest position R. After a ball has been delivered and after a short delay according to the rules of the game, the supportng member 43 is lowered into the operating position M and, after the pinfall detection having taken place, lifted back to the rest position R.

For the electronically processing of the output signals of the solar cells 44, they are either parallely connected, as shown in FIG. 13*a*, or serially connected, as shown in FIG. 13*b*. In any case the output of the solar cell battery is connected to a schmitt trigger 49, whose output generates a logical 0 signal if the beam hits the solar cells 44, or a logical 1 signal, if the beam is interrupted.

Another possibility within the scope of the present invention is to provide a reflector as a part of the light receiver. It may be remembered that the embodiment of FIG. 7 shows an arrangement of emitter 9 and receiver 10 within a common housing, whereby a reflector 23 serves to reflect the emitted beam S. Tape-like members 53 may be used as reflector elements, which are commercially available and are designed either as reflex foils or as triple reflectors. These reflective tapes 53 have the advantage that they send back an incoming light beam essentially in the same direction with only a slight parallel offset. Thereby the geometrical positioning of the reflector surface with reference to the axis of the light beam is not critical at all; the reflector may be tilted by as much as 45° with reference to the beam.

As can be seen from FIGS. 14 and 15, the tape-like reflector elements 53 are mounted in a supporting profile 51 made of rubber or plastic. The profile 51 comprises protective beads 50 protruding over the surface of the reflecting tape 53 and extending along the two longitudinal edges thereof. FIG. 16 shows that thereby a most useful protection of the surface of the reflective tape 53 against falling pins 12 may be achieved. The length and width of the reflector of FIGS. 14 and 15 may correspond to the embodiment shown in FIGS. 10 and 11.

Figure 17:
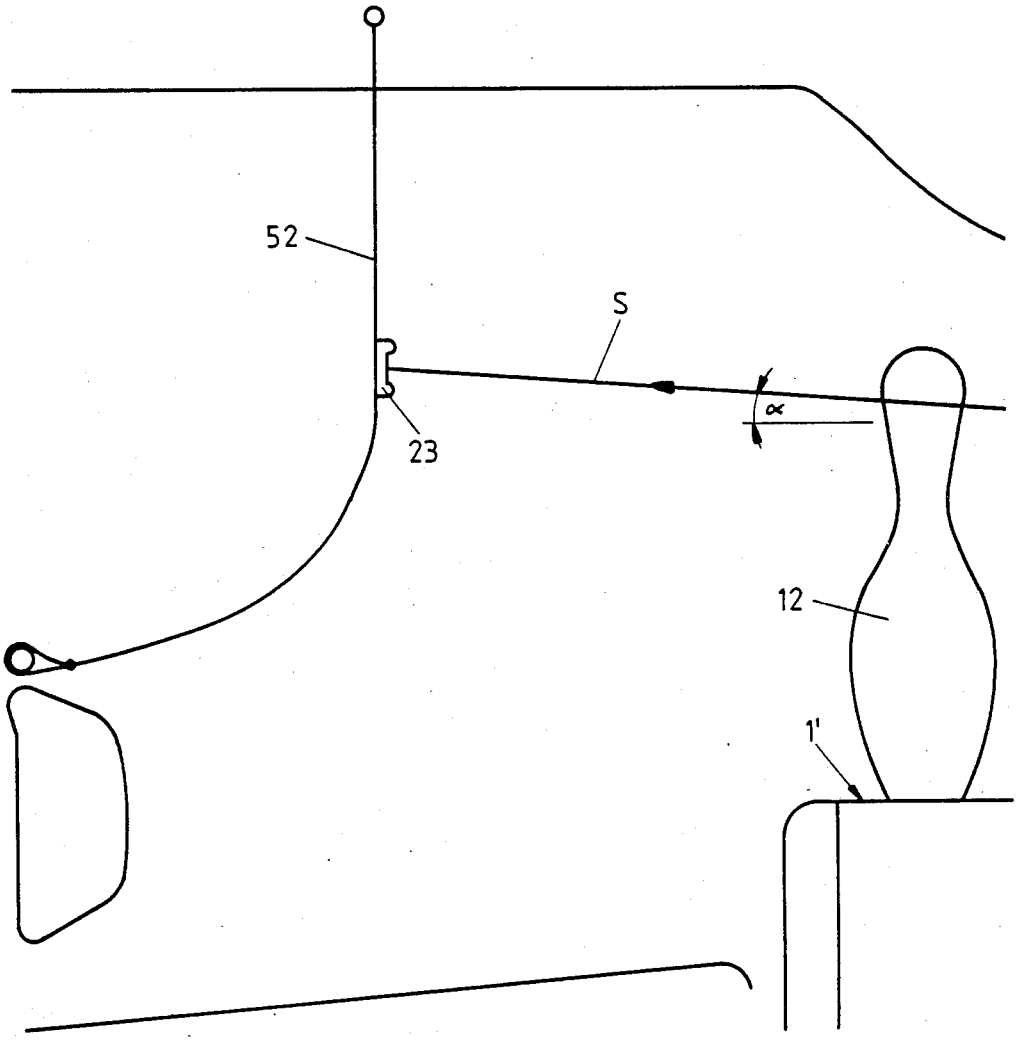
FIG. 17 shows a schematic partial vertical view of the back end of a bowling lane incorporating a first embodiment of the system according to the invention.
Figure 18:
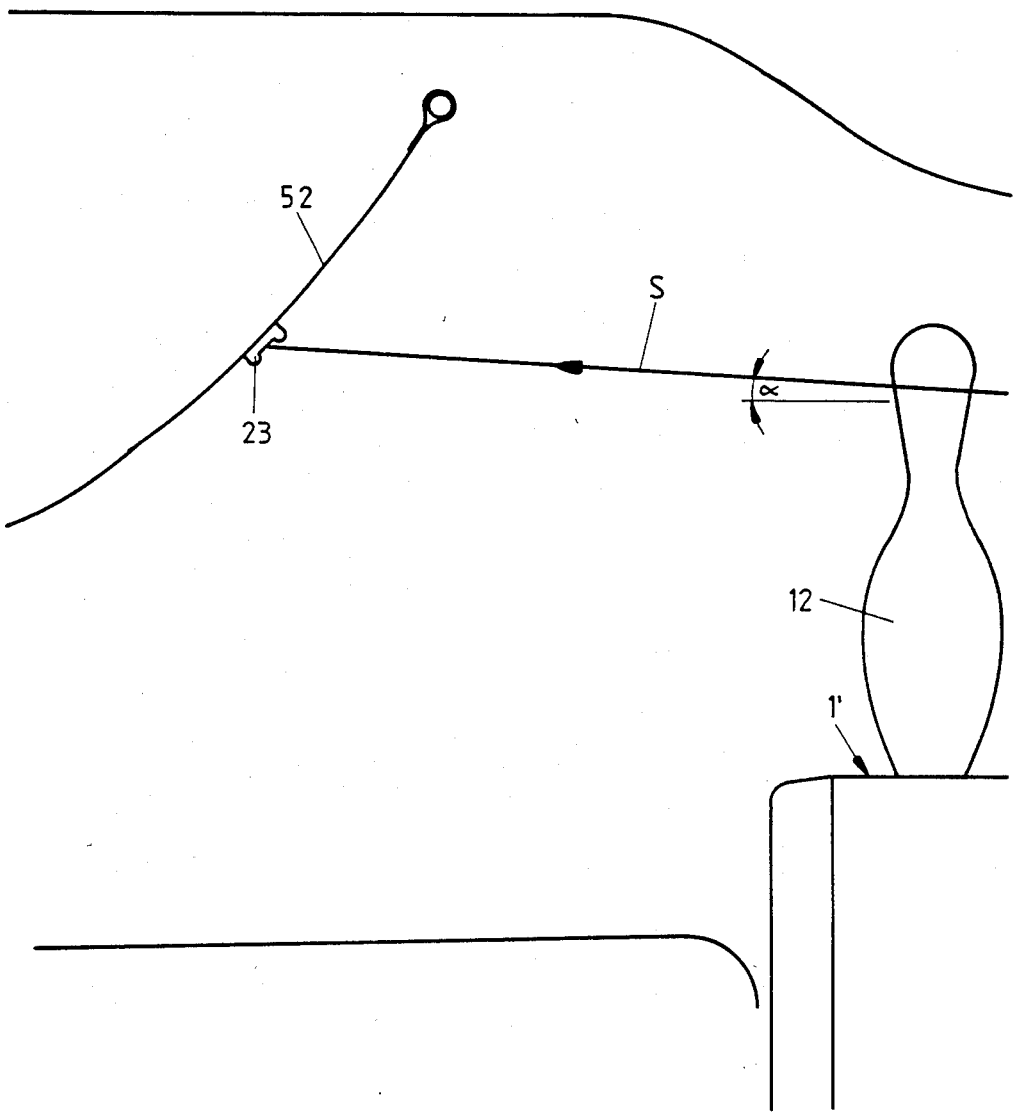
FIG. 18 shows a schematic partial vertical view of the back end of a bowling lane incorporating a second embodiment of the system according to the invention.

The arrangement of the reflector 23 at the end of the bowling lane 1 may be seen in FIGS. 17 and 18. These two embodiments differ only with respect of the mounting of the ball curtain 52 behind the end of the lane 1. The reflector 23 may be mounted to the curtain 52 by gluing or by any other convenient method. An oblique arrangement of the reflector 23 with reference to the beam axis S as seen in FIG. 18 has no negative effect, as already explained hereinbefore. All embodiments discussed hereinbefore refer to the bowling game and to a pinfall detection device to be used in connection with bowling alleys. It is understood that, after slight modification, also an alley for a ninepin game may be equipped with the pinfall detection system according to the invention.

A further modification of the pinfall detection system according to the invention might include further electronic circuitry to not only display the number of the knocked down pins, but also the position thereof, with other words, an identification thereof. This can be realized by a suitable supplemental electronic circuitry means connected to the processing circuitry 16, which records and processes the relation between the duration and occurrence of the beam interruption and the related sweep angle. Such a circuitry means is well known in the art and needs not to be further discussed here.

What I claim is:

1. A photoelectric pinfall detection system comprising:

a radiation emitting means standing offset to the longitudinal axis of a bowling lane in a predetermined distance to the pins and being adapted to emit an electromagnetic signal beam which is focussed at least in one plane;

a receiving means including a receiving element adapted to receive said electromagnetic beam emitted by said radiation emitting means and to generate a first output signal in response to the receipt of said electromagnetic beam and a second output signal, if no electromagnetic beam is received;

said electromagnetic beam emitted by said emitting means and said receiving element included in said receiving means being movably arranged with reference to each other in such a way that the electromagnetic beam is interrupted by each standing pin and that such interruption is detected during said relative movement of said beam and said receiving element, and said receiving element generating said second output signal for a time interval corresponding to the duration of the electromagnetic beam interruption;

an electronic circuitry means connected to said radiation emitting means and said receiving means, said electronic circuitry means receiving said first and said second output signals from said receiving means and being adapted to process said received first and second output signals, wherein said electronic circuitry means includes means for summing the time intervals of electromagnetic beam interruption for each pin that is standing, and means for transforming said summed intervals into the number of fallen pins, and said electronic circuitry means further including display means to display the number and position of the fallen pins in response to said first and second output signals.

2. A photoelectric pinfall detection system according to claim 1, wherein said electromagnetic beam emitted by said emitting means is a light beam.

3. A photoelectric pinfall detection system according to claim 2, wherein said emitting means comprises a light source which emits a short-wave light beam, particularly a light beam having a wavelength in the infrared spectrum, and further comprises optical focusing means positioned in front of said light source adapted to focus said light beam at least in one plane.

4. A photoelectric pinfall detection system according to claim 3, wherein said light source is a semiconductor diode.

5. A photoelectric pinfall detection system according to claim 3 or 4, wherein the light beam emitted from said light source is sharply focused along a single line.

6. A photoelectric pinfall detection system comprising:

a radiation emitting means standing offset to the longitudinal axis of a bowling lane in a predetermined distance to the pins and being adapted to emit an electromagnetic signal beam which is focussed at least in one plane, said radiation emitting means being pivotably or rotatably received on a supporting stand and being connected to a driving means adapted to drive said emitting means to a pivotal or rotational movement;

a receiving means including a receiving element adapted to receive said electromagnetic beam emitted by said radiation emitting means and to generate a first output signal in response to the receipt of said electromagnetic beam and a second output signal, if no electromagnetic beam is received;

said electromagnetic beam emitted by said emitting means thereby being pivotable or rotatable with reference to said receiving element included in said receiving means in such a way that the electromagnetic beam is interrupted by each standing pin during said relative movement of said beam and said receiving element, and said receiving element generating said second output signal for a time interval corresponding to the duration of the electromagnetic beam interruption;

an electronic circuitry means connected to said radiation emitting means, to said driving means and to said receiving means, said circuitry means receiving said first and second output signals from said receiving means and being adapted to process said received output signals wherein said electronic circuitry means includes means for summing the time intervals of electromagnetic beam interruption for each pin that is standing, and means for transforming said summed intervals into the number of fallen pins, and said circuitry means further including display means to display the number and position of the falled pins in response to said first and second output signals.

7. A photoelectric pinfall detection system according to claim 6, wherein said electromagnetic beam emitted by said emitting means is a light beam.

8. A photoelectric pinfall detection system according to claim 7, wherein said emitting means comprises a light source which emits a short-wave light beam, particularly a light beam having a wavelength in the infrared spectrum, and further comprises optical focussing means positioned in front of said light source adapted to focus said light beam at least in one plane.

9. A photoelectric pinfall detection system according to claim 8, wherein said light source is a semiconductor diode.

10. A photoelectric pinfall detection system according to claim 8 or 9, wherein the light beam emitted from said light source is sharply focused along a straight line.

11. A photoelectric pinfall detection system comprising:

a radiation emitting means standing offset to the longitudinal axis of a bowling lane in a predetermined distance to the pins and being adapted to emit an electromagnetic signal beam which is sharply focussed along a straight line, said radiation emitting means including a beam emitting source and a mirror pivotably or rotatably received on a supporting member in front of said beam emitting source and being adapted to deflect said signal beam emitted from said emitting source, said supporting member being connected to a driving means adapted to drive said mirror to a pivotal or rotational movement;

receiving means including a receiving element adapted to receive said electromagnetic beam emitted by said radiation emitting means and to generate a first output signal in response to the receipt of said electromagnetic beam and a second output signal, if no electromagnetic beam is received;

said electromagnetic beam emitted by said emitting means thereby being pivotable or rotatable under the influence of said mirror with reference to said receiving element included in said receiving means in such a way that the electromagnetic beam is interrupted by each standing pin during said relative movement of said beam and said receiving element, and said receiving element generating said output signal for a time interval corresponding to the duration of the electromagnetic beam interruption;

an electronic circuitry means connected to said radiation emitting means, to said driving means and to said receiving means, said circuitry means receiving said first and said second output signals from said receiving means and being adapted to process said received output signals, wherein said electronic circuitry means includes means for summing the time intervals of electromagnetic beam interruption for each pin that is standing, and means for transforming said summed intervals into the number of fallen pins, and said circuitry means further including display means to display the number and position of the fallen pins in response to said first and second output signals.

12. A photoelectric pinfall detection system according to claim 11, wherein said electromagnetic beam emitted by said emitting means is a light beam.

13. A photoelectric pinfall detection system according to claim 12, wherein said emitting means comprises a light source which emits a short-wave light beam, particularly a light beam having a wavelength in the infrared spectrum, and further comprises optical focussing means positioned in front of said light source adapted to focus said light beam at least in one plane.

14. A photoelectric pinfall detection system according to claim 13, wherein said light source is a semiconductor diode.

15. A photoelectric pinfall detection system according to claim 1, 6, or 11, wherein said receiving means is of elongate, striplike configuration and includes a plurality of individual receiving elements arranged in a row, one adjacent to another one.

16. A photoelectric pinfall detection system according to claim 15, wherein said elongate receiving means is arranged in the region of the end of the bowling lane, behind the pins, on a supporting structure, which is vertically displacable between a operating position, in which the receiving elements of the receiving means are positioned essentially in a height corresponding to the height of the heads of the pins, and a rest position, which is on a substantially higher level than said operating position.

17. A photoelectric pinfall detection system comprising:

a radiation emitting means standing offset to the longitudinal axis of a bowling lane in a predetermined distance to the pins and being adapted to emit an electromagnetic signal beam which is focussed in a essentially horizontally extending plane intersecting the heads of the pins at the end of the bowling lane;

a receiving means including a receiving element adapted to receive said electromagnetic beam emitted by said radiation emitting means and to generate a first output signal in response to the receipt of said electromagnetic beam and a second output signal, if no electromagnetic beam is received;

said receiving element being arranged on a supporting structure placed in the region of the end of the bowling lane behind the pins, in a height essentially corresponding to the height of the heads of the pins, said supporting structure comprising a driving means connected to said receiving element and being adapted to displace said receiving element in horizontal direction transversely to the longitudinal axis of the bowling lane from one edge thereof to the other one and vice versa;

said electromagnetic beam emitted by said emitting means being interrupted by each standing pin and said receiving element of said receiving means, during its displacement path along the width of the bowling lane, detecting the beam interruptions caused by the standing pins and thereby generating first and second output signals, and said receiving element generating said second output signal for a time interval corresponding to the duration of the electromagnetic beam interruption;

an electronic circuitry means connected to said radiation emitting means, said driving means and said receiving means, receiving said first and said second output signals from said receiving means and being adapted to process said received output signals, wherein said electronic circuitry means includes means for summing the time intervals of electromagnetic beam interruption for each pin that is standing, and means for transforming said summed intervals into the number of fallen pins, and further including display means to display the number and position of the fallen pins in response to said first and second output signals.

18. A photoelectric pinfall detection system according to claim 17, wherein said electromagnetic beam emitted by said emitting means is a light beam.

19. A photoelectric pinfall detection system according to claim 18, wherein said emitting means comprises a light source which emits a short-wave light beam, particularly a light beam having a wavelength in the infrared spectrum, and further comprises optical focussing means positioned in front of said light source adapted to focus said light beam in an essentially horizontally extending plane.

20. A photoelectric pinfall detection system according to claim 19, wherein said light source is a semiconductor diode.

21. A photoelectric pinfall detection system comprising:

a radiation emitting means standing offset to the longitudinal axis of a bowling lane in a predetermined distance to the pins and being adapted to emit an electromagnetic signal beam which is sharply focussed along a straight line, said radiation emitting means including a beam emitting source and a mirror pivotably or rotatably received on a supporting member in a front of said beam emitting source, said mirror being adapted to deflect said signal beam and being connected to a driving means adapted to drive said mirror to a pivotal or rotational movement;

a beam reflecting means arranged in the region of the end of the bowling lane, behind the pins and placed in a height essentially corresponding to the height of the head of a standing pin, said reflecting means being adapted to reflect the beam emitted by said radiation emitting means;

a receiving means including a receiving element arranged in the region of said radiation emitting means and adapted to receive said electromagnetic beam emitted by said radiation emitting means and reflected by said reflecting means, and being adapted to generate a first output signal in response to the receipt of said electromagnetic beam and a second output signal, if no electromagnetic beam is received;

said electromagnetic beam emitted by said emitting means thereby being pivotable or rotatable under the influence of said mirror with reference to said receiving element included in said receiving means in such a way that the electromagnetic beam is interrupted by each standing pin during said relative movement of said beam and said receiving element, and said receiving element generating said second output signal for a time interval corresponding to the duration of the electromagnetic beam interruption;

an electronic circuitry means connected to said radiation emitting means, to said driving means and to said receiving means, said circuitry receiving said first and said second output signals from said receiving means and being adapted to process said received output signals, wherein said electronic circuitry means includes means for summing the time intervals of electromagnetic beam interruption for each pin that is standing, and means for transforming said summed intervals into the number of fallen pins, and further including display means to display the number and position of the fallen pins in response to said first and second output signals.

22. A photoelectric pinfall detection system according to claim 21, wherein said electromagnetic beam emitted by said emitting means is a light beam.

23. A photoelectric pinfall detection system according to claim 22, wherein said emitting means comprises a light source which emits a short-wave light beam, particularly a light beam having a wavelength in the infrared spectrum, and further comprises optical focussing means positioned in front of said light source adapted to focus said light beam along a straight line.

24. A photoelectric pinfall detection system according to claim 23, wherein said light source is a semiconductor diode.

25. A photoelectric pinfall detection system according to claim 21, wherein said beam is a light beam and said reflecting means has the configuration of an elongate, essentially horizontally arranged tape made of a light-reflecting material.

26. A photoelectric pinfall detection system according to claim 25, wherein said light-reflecting tape is arranged in the central area of and supported by a supporting profile, which comprises protruding protective beads extending along both longitudinal edges of said tape.

27. A photoelectric pinfall detection system according to claim 25 or 26, wherein said tape is a light-reflex foil comprising a light-reflecting base and a plurality of small light-deflecting glass balls arranged on said base.

28. A photoelectric pinfall detection system according to claim 25 or 26, wherein said tape is a triple reflector tape.

29. A bowling alley with a plurality n of bowling lanes arranged parallel to each other and including photoelectric pinfall detection systems related to each bowling lane, comprising:

a plurality n+1 of radiation emitting means each standing offset to the longitudinal axis of an adjacent bowling lane in a predetermined distance to the pins of the adjacent bowling lane between each of two adjacent bowling lanes as well as at the two free edges of the two outermost bowling lanes, each of said radiation emitting means being adapted to emit an electromagnetic signal beam which is focussed at least in one plane;

a plurality n of receiving means each including a receiving element adapted to receive said electromagnetic beam emitted by one of said radiation emitting means and to generate a first output signal in response to the receipt of said electromagnetic beam and a second output signal, if no electromagnetic beam is received;

said electromagnetic beam emitted by said emitting means and said receiving element included in said receiving means being movably arranged with reference to each other in such a way that the electromagnetic beam is interrupted by each standing pin and that such interruption is detected during said relative movement of said beam and said receiving element, and said receiving element generating said second output signal for a time interval corresponding to the duration of the electromagnetic beam interruption;

a plurality of electronic circuitry means each related to an individual bowling lane, each of said electronic circuitry means being connected to two adjacent radiation means and to the related receiving means, said electronic circuitry means receiving said first and said second output signals from said receiving means and being adapted to process said received first and second output signals, wherein said electronic circuitry means includes means for summing the time intervals of electromagnetic beam interruption for each pin that is standing, and means for transforming said summed intervals into the number of fallen pins, and said electronic circuitry means further including display means to display the number and position of the fallen pins of the related bowling lane in response to said first and second output signals.

30. A photoelectric pinfall detection system according to claim 29, wherein said electromagnetic beam emitted from one of said emitting means is received by the receiving means related to two adjacent bowling lanes and processed by the electronic circuitry means related to said two adjacent bowling lanes.

31. A photoelectric pinfall detection system according to claim 29, wherein said electromagnetic beam emitted by said emitting means is a light beam.

32. A photoelectric pinfall detection system according to claim 31, wherein said emitting means comprises a light source which emits a short-wave light beam, particularly a light beam having a wavelength in the infrared spectrum, and further comprises optical focussing means positioned in front of said light source adapted to focus said light beam at least in one plane.

33. A photoelectric pinfall detection system according to claim 32, wherein said light source is a semiconductor diode.

34. A photoelectric pinfall detection system according to claim 32 or 33, wherein the light beam emitted from said light source is sharply focussed along a straight line.

* * * * *